US011295673B2

(12) United States Patent
Park et al.

(10) Patent No.: US 11,295,673 B2
(45) Date of Patent: Apr. 5, 2022

(54) DISPLAY DEVICE

(71) Applicant: SAMSUNG DISPLAY CO., LTD., Yongin-si (KR)

(72) Inventors: Jun Hyun Park, Yongin-si (KR); Bon Yong Koo, Yongin-si (KR); Byung Chang Yu, Yongin-si (KR); Yu Jin Lee, Yongin-si (KR); Kyung Hoon Chung, Yongin-si (KR)

(73) Assignee: SAMSUNG DISPLAY CO., LTD., Gyeonggi-do (KR)

( * ) Notice: Subject to any disclaimer, the term of this patent is extended or adjusted under 35 U.S.C. 154(b) by 0 days.

(21) Appl. No.: 17/070,438

(22) Filed: Oct. 14, 2020

(65) Prior Publication Data

US 2021/0256908 A1 Aug. 19, 2021

(30) Foreign Application Priority Data

Feb. 19, 2020 (KR) ..... 10-2020-0020319

(51) Int. Cl.

| | |
|---|---|
| ***G09G 3/3233*** | (2016.01) |
| ***G09G 3/3258*** | (2016.01) |
| ***G09G 3/3266*** | (2016.01) |
| ***G09G 3/3275*** | (2016.01) |

(52) U.S. Cl.

CPC ..... *G09G 3/3258* (2013.01); *G09G 3/3266* (2013.01); *G09G 3/3275* (2013.01); *G09G 2300/0426* (2013.01); *G09G 2300/0809* (2013.01); *G09G 2310/08* (2013.01); *G09G 2320/0626* (2013.01); *G09G 2330/021* (2013.01); *G09G 2330/028* (2013.01)

(58) Field of Classification Search

CPC ..... G09G 3/3233; G09G 3/3291; G09G 2300/0852; G09G 2310/0205; G09G 2320/045

See application file for complete search history.

(56) References Cited

U.S. PATENT DOCUMENTS

| | | | | |
|---|---|---|---|---|
| 8,587,578 | B2 | 11/2013 | Choi | |
| 10,453,391 | B2 | 10/2019 | Chen et al. | |
| 2005/0017934 | A1* | 1/2005 | Chung | G09G 3/3233 345/82 |
| 2005/0093787 | A1* | 5/2005 | Kim | G09G 3/3233 345/76 |

(Continued)

FOREIGN PATENT DOCUMENTS

| | | | |
|---|---|---|---|
| KR | 100683772 | B1 | 2/2007 |
| KR | 101040806 | B1 | 6/2011 |

(Continued)

*Primary Examiner* — Michael J Eurice

(74) *Attorney, Agent, or Firm* — Cantor Colburn LLP

(57) ABSTRACT

A display device includes a display panel including a plurality of pixels, a timing controller which generates an emission start signal, an emission driver which supplies an emission control signal to the plurality of pixels based on the emission start signal received from the timing controller, a first scan driver which supplies a first scan signal to the plurality of pixels, a second scan driver which supplies a second scan signal to the plurality of pixels, and a data driver which supplies a data signal to the plurality of pixels. The timing controller adjusts a period in which the emission start signal is supplied based on a change of a driving frequency.

18 Claims, 9 Drawing Sheets

(56) References Cited

U.S. PATENT DOCUMENTS

| | | | | |
|---|---|---|---|---|
| 2011/0057917 | A1* | 3/2011 | Ryu | G09G 3/3266 345/211 |
| 2011/0157125 | A1* | 6/2011 | Choi | G09G 3/3233 345/211 |
| 2015/0279274 | A1* | 10/2015 | Pyo | G09G 3/3233 345/77 |
| 2016/0063961 | A1* | 3/2016 | Pyo | G09G 3/3266 345/213 |
| 2017/0124958 | A1* | 5/2017 | Pyo | G09G 3/3233 |
| 2018/0374419 | A1* | 12/2018 | Chen | G09G 3/3233 |
| 2021/0027701 | A1 | 1/2021 | Park et al. | |
| 2021/0027702 | A1 | 1/2021 | Park et al. | |
| 2021/0134210 | A1 | 5/2021 | In et al. | |

FOREIGN PATENT DOCUMENTS

| | | | |
|---|---|---|---|
| KR | 1020210011553 | A | 2/2021 |
| KR | 1020210011554 | A | 2/2021 |
| KR | 1020210054114 | A | 5/2021 |

* cited by examiner

DISPLAY DEVICE

This application claims priority to Korean Patent Application No. 10-2020-0020319, filed on Feb. 19, 2020, and all the benefits accruing therefrom under 35 U.S.C. § 119, the content of which in its entirety is herein incorporated by reference.

BACKGROUND

1. Field

The disclosure relates to a display device, and more particularly, to a pixel and a display device including the pixel.

2. Discussion of the Related Art

As an information technology is developed, importance of a display device, which is a connection medium between a user and information, is emphasized. Accordingly, use of a display device such as a liquid crystal display device, an organic light emitting display device, and a plasma display device has been increasing.

Each pixel of the display device may include transistors including a driving transistor, and may emit light at a luminance corresponding to a data voltage supplied through a data line. The display device may display an image frame with an emission combination of the pixels.

SUMMARY

Recently, high speed driving for displaying a screen at a high frequency, e.g., 120 hertz (Hz), has been desired to improve image quality. However, under the high speed driving, a threshold voltage charge time for a driving transistor of each pixel may be shortened.

Embodiments of the disclosure provide a display device in which a threshold voltage of a driving transistor is effectively compensated even when the display device is driven at a high driving frequency.

According to an embodiment of the invention, a display device includes a display panel including a plurality of pixels, a timing controller which generates an emission start signal, an emission driver which supplies an emission control signal to the plurality of pixels based on the emission start signal received from the timing controller, a first scan driver which supplies a first scan signal to the plurality of pixels, a second scan driver which supplies a second scan signal to the plurality of pixels, and a data driver which supplies a data signal to the plurality of pixels. In such an embodiment, the timing controller adjusts a period, in which the emission start signal is supplied, based on a change of a driving frequency.

In an embodiment, the timing controller may increase the period in which the emission start signal is supplied, as the driving frequency increases.

In an embodiment, the timing controller may adjust a cycle of a clock signal supplied to the emission driver based on the change of the driving frequency.

In an embodiment, a supply period of the emission control signal output by the emission driver when the driving frequency is a first driving frequency may be the same as a supply period of the emission control signal output by the emission driver when the driving frequency is a second driving frequency, where the second driving frequency may be greater than the first driving frequency.

In an embodiment, each of the plurality of pixels may include a first transistor, a light emitting element including a first electrode electrically connected to a second electrode of the first transistor and a second electrode connected to a second power source, and a third transistor connected between the second electrode of the first transistor and a gate electrode of the first transistor, where the third transistor may include a gate electrode which receives the second scan signal.

In an embodiment, each of the plurality of pixels may include a fifth transistor connected between a first power source and the first electrode of the first transistor, where the fifth transistor may include a gate electrode which receives the emission control signal, and a sixth transistor connected between the second electrode of the first transistor and the first electrode of the light emitting element, where the sixth transistor may include a gate electrode which receives a previous emission control signal.

In an embodiment, each of the plurality of pixels may include a second transistor connected between a data line receiving the data signal and a third node, where the second transistor may include a gate electrode which receives the first scan signal, a fourth transistor connected between the first power source and the third node, where the fourth transistor may include a gate electrode which receives the emission control signal, a first capacitor connected between the second electrode of the first transistor and the third node, a second capacitor connected between the first power source and the gate electrode of the first transistor, and a seventh transistor connected between the first electrode of the light emitting element and an initialization power source, where the seventh transistor may include a gate electrode which receives the second scan signal.

In an embodiment, in a period in which the second scan signal is in a gate-on level, a period in which the previous emission control signal is in a gate-on level may not overlap a period in which the emission control signal is in a gate-on level.

In an embodiment, a voltage of the initialization power source may be supplied to the gate electrode of the first transistor and the first electrode of the light emitting element in a first period, a voltage of the first power source may be supplied to the first electrode of the first transistor in a second period, the first transistor may be diode-connected based on the voltage of the first power source in a third period, and the second transistor may be turned on and the data signal may be supplied to the third node in a fourth period.

In an embodiment, the third transistor may be turned on in the first period, the third period and the fourth period, and the third transistor may be turned off in the second period.

In an embodiment, the fourth transistor and the fifth transistor may be turned off and the sixth transistor may be turned on in the first period.

In an embodiment, the fourth transistor and the fifth transistor may be turned on and the sixth transistor may be turned off in the third period.

In an embodiment, the emission driver may include a first emission driver which supplies the emission control signal to the plurality of pixels, and a second emission driver which supplies the previous emission control signal to the plurality of pixels through a line independently of the emission control signal.

In an embodiment, the first scan driver or the second scan driver may be located on both opposing sides of the display panel to operate in both side driving, and the first emission driver or the second emission driver may be located on a single side of the display panel to operate in single side driving.

In an embodiment, the first scan driver may shift the first scan signal and supply a shifted scan signal to pixels located in one row in the display panel, the second scan driver may simultaneously supply the second scan signal to pixels located in two or more successive rows in the display panel, the first emission driver may simultaneously supply the emission control signal to the pixels located in the two or more successive rows in the display panel, and the second emission driver may simultaneously supply the previous emission control signal to the pixels located in the two or more successive rows in the display panel.

In an embodiment, each of the plurality of pixels may include a second transistor connected between a data line which receives the data signal and a third node, where the second transistor may include a gate electrode which receives the first scan signal, a fourth transistor connected between a reference power source that is set differently based on the driving frequency and the third node, wherein the fourth transistor may include a gate electrode which receives the emission control signal, a first capacitor connected between the second electrode of the first transistor and the third node, a second capacitor connected between the first power source and the gate electrode of the first transistor, and a seventh transistor connected between the first electrode of the light emitting element and an initialization power source, where the seventh transistor may include a gate electrode which receives the second scan signal.

In an embodiment, each of the plurality of pixels may further include a second transistor connected between a data line receiving the data signal and the first electrode of the first transistor, where the second transistor may include a gate electrode which receives the first scan signal, a fifth transistor connected between a first power source and the first electrode of the first transistor, where the fifth transistor may include a gate electrode which receives the emission control signal, and a sixth transistor connected between the second electrode of the first transistor and the first electrode of the light emitting element, where the sixth transistor may include a gate electrode which receives the emission control signal.

In an embodiment, the second scan driver may increase a period in which the second scan signal is supplied, as the driving frequency increases.

In an embodiment, each of the plurality of pixels may further include a fourth transistor connected between the gate electrode of the first transistor and an initialization power source, where the fourth transistor may include a gate electrode which receives a previous first scan signal, a seventh transistor connected between the initialization power source and the first electrode of the light emitting element, where the seventh transistor may include a gate electrode which receives the first scan signal, and a storage capacitor connected between the first power source and the gate electrode of the first transistor.

In an embodiment, a period in which the previous first scan signal is in a gate-on level may not overlap a period in which the first scan signal is in a gate-on level.

In an embodiment of a pixel and the display device including the pixel according the disclosure, a threshold voltage of a driving transistor is effectively compensated by providing a second emission control signal to the pixel through a separate emission driver.

In such an embodiment, the threshold voltage of the driving transistor may be compensated for using a voltage of the first power source that is a constant voltage source or a data voltage.

In such an embodiment, a time for compensating for the threshold voltage of the driving transistor may be sufficiently ensured even in high speed driving by adjusting the emission start signal differently based on the driving frequency of the display device.

BRIEF DESCRIPTION OF THE DRAWINGS

The above and other features of the disclosure will become more apparent by describing in further detail embodiments thereof with reference to the accompanying drawings, in which.

DETAILED DESCRIPTION

Figure 1:
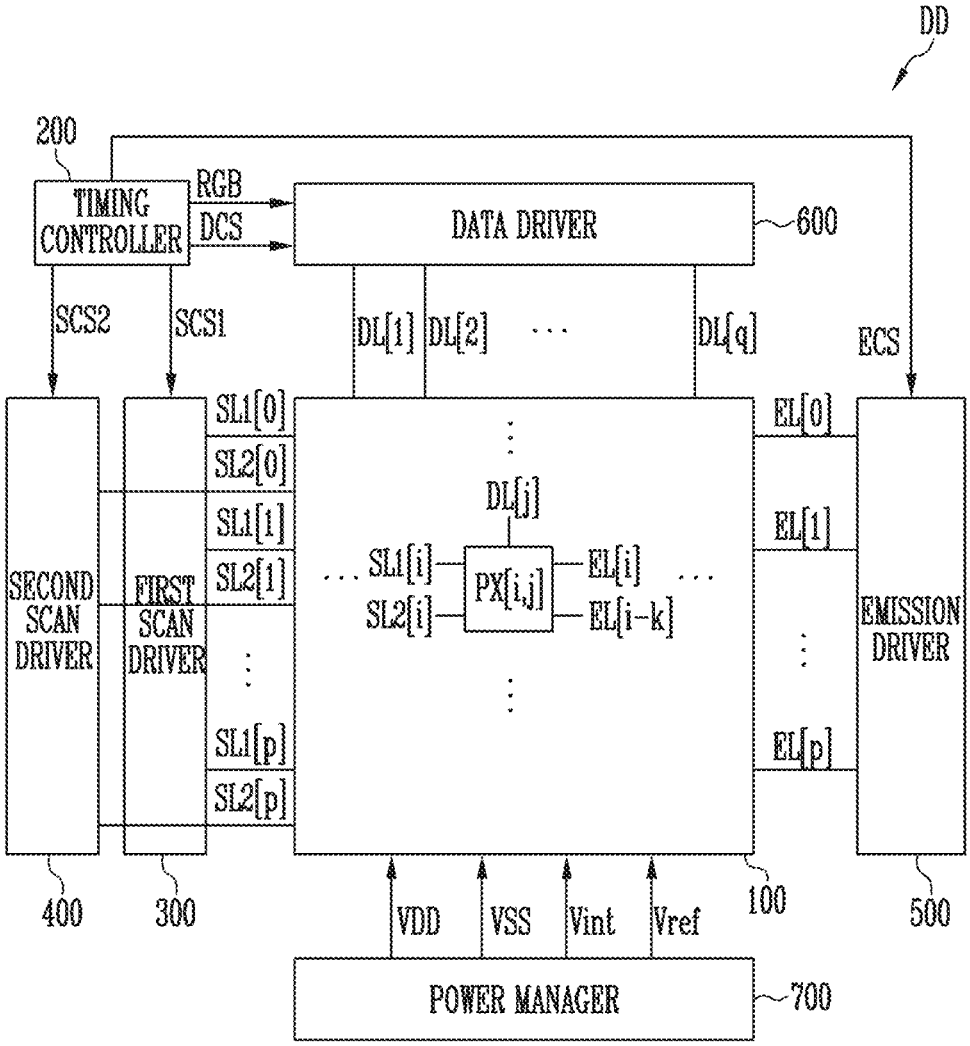
FIG. 1 is a block diagram illustrating a display device according to an embodiment of the disclosure.

The invention now will be described more fully hereinafter with reference to the accompanying drawings, in which various embodiments are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element's as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower," can therefore, encompasses both an orientation of "lower" and "upper," depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Hereinafter, embodiments of the invention will be described in detail with reference to the accompanying drawings.

FIG. 1 is a block diagram illustrating a display device according to an embodiment of the disclosure.

Referring to FIG. 1, an embodiment of the display device DD may include a display panel 100, a timing controller 200, a first scan driver 300, a second scan driver 400, an emission driver 500, a data driver 600, and a power manager 700.

The timing controller 200 may generate a first driving control signal SCS1, a second driving control signal SCS2, a third driving control signal ECS, and a fourth driving control signal DCS in correspondence with synchronization signals supplied from an outside. The first driving control signal SCS1 may be supplied to the first scan driver 300, the second driving control signal SCS2 may be supplied to the second scan driver 400, the third driving control signal ECS may be supplied to the emission driver 500, and the fourth driving control signal DCS may be supplied to the data driver 600. In an embodiment, the timing controller 200 may rearrange or convert input image data supplied from the outside into image data RGB to supply the image data RGB to the data driver 600.

The first driving control signal SCS1 may include a first scan start signal and clock signals. The first scan start signal may control a first timing of the first scan signal. The clock signals may be used to shift the first scan start signal.

The second driving control signal SCS2 may include a second scan start signal and clock signals. The second scan start signal may control a first timing of the second scan signal. The clock signals may be used to shift the second scan start signal.

The third driving control signal ECS may include an emission start signal and clock signals. The emission start signal may control a first timing of an emission signal. The clock signals may be used to shift the emission start signal.

The fourth driving control signal DCS may include a source start pulse and clock signals. The source start pulse may control a sampling start time of data. The clock signals may be used to control a sampling operation.

The clock signals may be a frequency signal corresponding to a driving frequency of the display device DD. Therefore, the timing controller may adjust a cycle of the clock signal supplied to the emission driver in correspondence with a change of the driving frequency.

In an embodiment, the timing controller 200 may generate the emission start signal corresponding to the driving frequency of the display device DD. In one embodiment, for example, the timing controller 200 may increase a period in which the emission start signal is supplied, as the driving frequency increases.

The first scan driver 300 may receive the first driving control signal SCS1 from the timing controller 200, and sequentially supply a first scan signal to first scan lines SL1[0], SL1[1], . . . , and SL1[*p*] based on the first driving control signal SCS1. When the first scan signal is sequentially supplied, pixels PX may be selected (or turned on) in a horizontal line unit (or a pixel row unit), and a data signal may be supplied to the selected pixels PX.

The first scan signal may be set to a gate on level (for example, a low level voltage). A transistor (for example, a second transistor T2 of FIG. 2 which will be described later) in the pixel PX and receiving the first scan signal may be turned on or in a turn-on state when the first scan signal is supplied.

The second scan driver 400 may receive the second driving control signal SCS2 from the timing controller 200, and sequentially supply a second scan signal to second scan lines SL2[0], SL2[1], . . . , and SL2[*p*] based on the second driving control signal SCS2.

The second scan signal may be set to a gate on level (for example, a low level voltage). A transistor in the pixel PX and receiving the second scan signal (for example, a third transistor T3 and a seventh transistor T7 of FIG. 2) may be turned on or in a turn-on state when the second scan signal is supplied.

The first scan driver 300 and the second scan driver 400 may include scan stages in a form of shift registers. The first scan driver 300 and the second scan driver 400 may generate the first scan signal and the second scan signal by sequentially transferring the scan start signals that include a pulse form of a turn-on level to a next scan stage under control of the clock signal.

The emission driver 500 may receive the third driving control signal ECS (or the emission start signal in the third driving control signal) from the timing controller 200, and sequentially supply an emission control signal to emission control lines EL[0], EL[1], . . . , and EL[p] based on the third driving control signal ECS (or the emission start signal).

The emission control signal may be set to a gate on level (for example, a low level voltage). A transistor in the pixel PX and receiving the emission control signal may be turned on or in a turn-on state when the emission control signal is supplied, and may be turned off or in a turn-off state when the emission control signal is not supplied.

The emission control signal may control an emission time of pixels PX[i, j]. In an embodiment, the emission control signal may be set to a width wider than that of the scan signal. In an embodiment, the emission control signal may have a plurality of gate off level (for example, high level voltage) periods during one frame period.

The display panel 100 may include a plurality of pixels PX[i, j]. The plurality of pixels PX[i, j] may be arranged in a matrix form with p rows (p is a natural number) and q columns (q is a natural number), and pixels PX [i, j] located in a same row may be connected to a same first scan line, a same second scan line, and a same emission control line. In such an embodiment, pixels PX[i, j] located in a same column may be connected to a same data line.

In one embodiment, for example, a pixel PX [i, j] located in an i-th row and a j-th column may be connected to a first scan line SL1[*i*] corresponding to the i-th row (or horizontal line), a second scan line SL2[*i*] corresponding to the i-th row, an emission control line EL[i] corresponding to the i-th row, and a data line DL[q] corresponding to the q-th column.

Alternatively, the first scan lines SL1[0], SL1[1], . . . , and SL1[*p*], the second scan lines SL2[0], SL2[1], . . . , and SL2[*p*], the emission control lines EL[0], EL[1], . . . , and EL[p], and data lines DL[1], DL[2], . . . , and DL[q] may be variously modified according to a circuit configuration. In one embodiment, for example, the pixel PX[i, j] located in the i-th row and the j-th column may be connected to an emission control line EL[i−k] (k is a natural number equal to or less than 10) corresponding to an (i−k)-th row.

The data driver 600 may receive the fourth driving control signal DCS and the image data RGB from the timing controller 200. The data driver 600 may supply the data signal to the data lines DL[1], DL[2], . . . , and DL[q] in correspondence with the fourth driving control signal DCS. The data signal supplied to the data lines DL[1], DL[2], . . . , and DL[q] may be supplied to the pixels PX[i, j] selected by the first scan signal. In such an embodiment, the data driver 600 may supply the data signal to the data lines DL[1], DL[2], and DL[q] to be synchronized with the first scan signal.

The power manager 700 may supply a voltage of a first power source VDD, a voltage of a second power source VSS, and a voltage of an initialization power source Vint to the display panel 100. In an embodiment, the power manager 700 may further supply a voltage of a reference power source Vref (refer to description of FIG. 2) to the display panel 100.

The power manager 700 may supply a low power source and a high power source corresponding to a gate-on level and a gate-off level of the first scan signal, the second scan signal, and/or the emission control signal to the first scan driver 300, the second scan driver 400, and/or the emission driver 500. The low power source may have a voltage level lower than that of the high power source. However, this is merely exemplary, and alternatively, at least one selected from the first power source VDD, the second power source VSS, the initialization power source Vint, the low power source, and the high power source may be supplied from the timing controller 200 or the data driver 600.

The first power source VDD and the second power source VSS may generate voltages for driving light emitting elements in each pixel of the display panel 100. In an embodiment, the voltage of the second power source VSS may be lower than the voltage of the first power source VDD. In one embodiment, for example, the voltage of the first power source VDD may be a positive voltage, and the voltage of the second power source VSS may be a negative voltage.

The initialization power source Vint may be a power source that initializes each pixel PX in the display panel 100. In one embodiment, for example, the driving transistor and/or the light emitting element in the pixel PX may be initialized by the voltage of the initialization power source Vint. The initialization power source Vint may be a negative voltage.

Hereinafter, for convenience of description, the pixel located in the i-th row and the j-th column may be referred to as the pixel PX [i, j], the first scan line corresponding to the i-th row may be referred to as the first scan line SL1[*i*], the second scan line corresponding to the i-th row may be referred to as the second scan line SL2[*i*], the emission control line corresponding to the i-th row may be referred to as the emission control line EL[i], and the data line corresponding to the j-th column may be referred to as the data line DL[j]. In addition, the emission control line corresponding to the (i−k)-th row (k is a natural number equal to or less than 10) may be referred to as a previous emission control line EL[i−k].

In such an embodiment, the first scan signal may be supplied to the first scan line SL1[*i*], the second scan signal may be supplied to the second scan line SL2[*i*], the emission control signal may be supplied the emission control line EL[I, and the previous emission control signal may be supplied to the previous emission control line EL[i−k].

Figure 2:
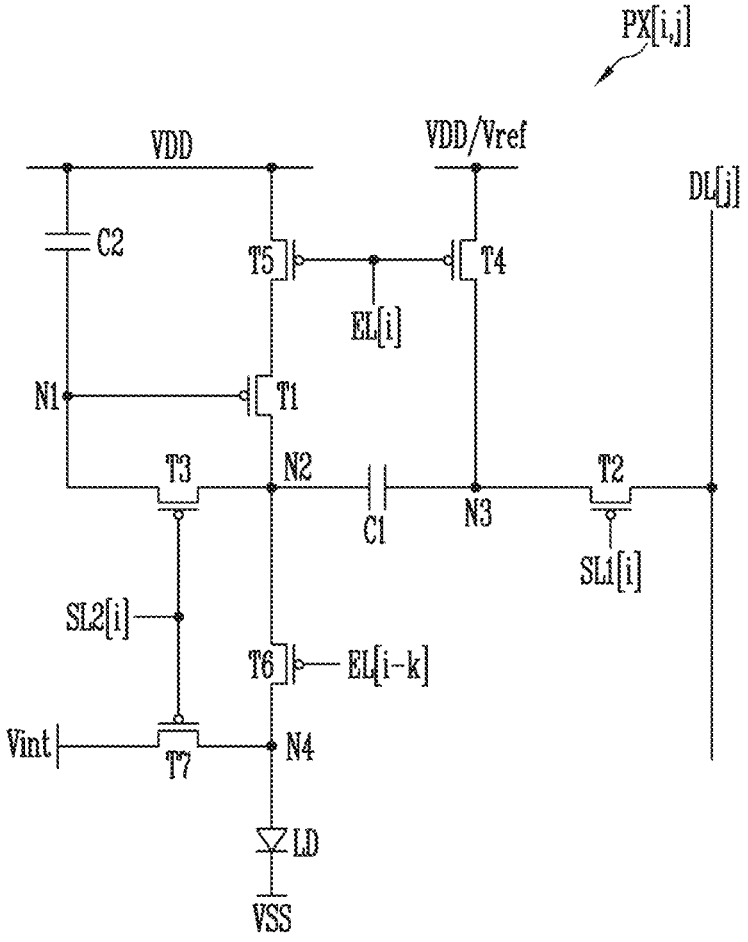
FIG. 2 is a circuit diagram illustrating a pixel according to an embodiment of the disclosure.

FIG. 2 is a circuit diagram illustrating the pixel according to an embodiment of the disclosure.

In FIG. 2, for convenience of illustration and description, the pixel PX[i, j] located in the i-th row (or horizontal line) and the j-th column is shown, but other pixels may have a same configuration as the pixel PX[i, j].

Referring to FIG. 2, an embodiment of the pixel PX[i, j] may include a light emitting element LD, first to seventh transistors T1 to T7, a first capacitor C1, and a second capacitor C2.

The light emitting element LD may include a first electrode electrically connected to a second electrode (for example, a drain electrode) of the first transistor T1 and a second electrode connected to the second power source VSS. In an embodiment, the first electrode of the light emitting element LD may be electrically connected to the second electrode of the first transistor T1 through the sixth transistor T6.

The light emitting element LD may generate light of a predetermined luminance in correspondence with an amount a current (a driving current) supplied from the first transistor T1. In an embodiment, the light emitting element LD may be an organic light emitting diode including an organic light emitting layer. In an embodiment, the first electrode of the light emitting element LD may be an anode electrode, and the second electrode may be a cathode electrode. Alternatively, the first electrode of the light emitting element LD may be a cathode electrode and the second electrode may be an anode electrode.

In an alternative embodiment, the light emitting element LD may be an inorganic light emitting element including or formed of an inorganic material. Alternatively, the light emitting element LD may have a structure in which a plurality of inorganic light emitting elements are connected in parallel and/or in series between the second power source VSS and the second electrode of the first transistor T1.

The first transistor T1 may include a first electrode electrically connected to the first power source VDD, the second electrode electrically connected to the first electrode of the light emitting element LD, and a gate electrode connected to a first node N1. In an embodiment, the first electrode of the first transistor T1 may be connected to the first power source VDD through the fifth transistor T5. The second electrode of the first transistor T1 may be connected to the light emitting element LD through the sixth transistor T6. The first transistor T1 may supply the driving current to the light emitting element LD. The first transistor T1 may function as a driving transistor of the pixel PX[i, j]. In such an embodiment, the first transistor T1 may control the current amount flowing from the first power source VDD to the second power source VSS via the light emitting element LD in correspondence with a voltage applied to the first node N1.

The first capacitor C1 may be connected between a second node N2 corresponding to the second electrode of the first transistor T1, and a third node N3. The first capacitor C1 may be charged with a differential voltage between the second node N2 and the third node N3.

The second capacitor C2 may be connected between the first power source VDD and the first node N1 corresponding to the gate electrode of the first transistor T1. The second capacitor C2 may be charged with a differential voltage between the first power source VDD and the first node N1.

The second transistor T2 may be connected between the data line DL[j] and the third node N3. The second transistor T2 may include a gate electrode that receives the first scan signal. In one embodiment, for example, the gate electrode of the second transistor T2 may be connected to the first scan line SL1[*i*]. The second transistor T2 may be turned on when the first scan signal is supplied to the first scan line SL1[*i*] to electrically connect the data line DL[j] and the third node N3 to each other. Therefore, a data voltage (or data signal) supplied to the data line DL[j] may be transferred to the third node N3.

In an embodiment, when the second transistor T2 is turned on in correspondence with the first scan signal supplied to the first scan line SL1[*i*], the data signal supplied through the data line DL[j] may be written to the pixel PX[i, j]. In such an embodiment, the first node N1 and the second node N2 may have a voltage corresponding to a capacitance ratio between the first capacitor C1 and the second capacitor C2 by charge sharing between the first capacitor C1 and the second capacitor C2.

The third transistor T3 may be connected between the first node N1 and the second node N2. The third transistor T3 may include a gate electrode that receives the second scan signal. In one embodiment, for example, the gate electrode of the third transistor T3 may be connected to the second scan line SL2[*i*]. The third transistor T3 may be turned on when the second scan signal is supplied to the second scan line SL2[*i*] to electrically connect the first node N1 and the second node N2 to each other. When the first node N1 and the second node N2 are electrically connected to each other, the first transistor T1 may have a form equivalent to a diode or become a diode-connected transistor. When the first transistor T1 has the form equivalent to the diode, a threshold voltage of the first transistor T1 may be compensated by a charge charged in the first electrode of the first transistor T1.

The first transistor T1 may supply the driving current to the light emitting element LD based on the data signal supplied from the data line DL[j], the first capacitor C1, and the second capacitor C2. The driving current may satisfy Equation 1 below.

$$Id = \rho \cdot [\alpha \cdot (Vdd - Vdata)],\ \alpha = \frac{CC1}{CC1 + CC2} \quad \text{[Equation 1]}$$

In Equation 1, Id denotes the driving current, ρ denotes an intrinsic characteristic of the first transistor T1, Vdd denotes the voltage of the first power source VDD, Vdata denotes a data signal, CC1 denotes a capacitance of the first capacitor C1, and CC2 denotes a capacitance of the second capacitor C2. The light emitting element LD may emit light at a luminance corresponding to the driving current Id.

The fourth transistor T4 may be connected between the first power source VDD and the third node N3. The fourth transistor T4 may include a gate electrode that receives the emission control signal (the emission control signal corresponding to the i-th pixel row). The gate electrode of the fourth transistor T4 may be connected to the emission control line EL[i] (or the emission control line corresponding to the i-th pixel row). The fourth transistor T4 may be turned on when the emission control signal is supplied to the emission control line EL[i] to supply the voltage of the first power source VDD to the third node N3. Therefore, a voltage of the third node N3 may be initialized to the voltage of the first power source VDD.

In an embodiment, the fourth transistor T4 may be coupled between the reference power source Vref, which is different from the first power source VDD, and the third node N3. In such an embodiment, when the fourth transistor T4 is turned on, the fourth transistor T4 may supply a voltage of the reference power source Vref to the third node N3. In such an embodiment, since the reference power source Vref initializes the voltage of the third node N3, the reference power source Vref may be set differently according to the driving frequency of the display device DD for the purpose of compensating for a luminance increased during a high speed driving. In one embodiment, for example, as the driving frequency of the display device DD increases, the voltage of the reference power source Vref is set to be low, and thus the light emitting element LD may emit light at a constant luminance regardless of a driving frequency change.

The fifth transistor T5 may be connected between the first power source VDD and the first electrode of the first transistor T1. The fifth transistor T5 may include a gate electrode that receives the emission control signal. In one embodiment, for example, the gate electrode of the fifth transistor T5 may be connected to the emission control line EL[i]. The fifth transistor T5 may be turned on when the emission control signal is supplied through the emission control line EL[i] to connect the first electrode of the first transistor T1 to the first power source VDD. Therefore, as the emission control signal is supplied through the emission control line EL[i], the voltage, or a direct current ("DC") voltage, of the first power source VDD connected to the first electrode of the first transistor T1 may be used to compensate for the threshold voltage of the first transistor T1.

The sixth transistor T6 may be connected between the second node N2 corresponding to the second electrode of the first transistor T1 and the fourth node N4 corresponding to the first electrode of the light emitting element LD. The sixth transistor T6 may include a gate electrode that receives the previous emission control signal. In one embodiment, for example, the gate electrode of the sixth transistor T6 may be connected to the previous emission control line EL[i−k].

The previous emission control signal may be an emission control signal corresponding to an (i−k)-th pixel row. In an embodiment, the previous emission control line EL[i−k] may be a line branched from the emission control line corresponding to the (i−k)-th pixel row. In such an embodiment, the emission control signal may be a signal in which the previous emission control signal is shifted by k horizontal periods. In an embodiment, k may be 3 or 6, but this is merely exemplary, and is not limited thereto. In one alternative embodiment, for example, the previous emission control line EL[i−k] or the previous emission control signal may be determined based on a time for threshold voltage compensation, the number of simultaneously controlled pixel rows, a resolution, a length of one horizontal period 1H, a relationship with the emission control signal supplied through the emission control line EL[i], and the like.

The sixth transistor T6 may be turned on when the previous emission control signal is supplied to the previous emission control line EL[i−k] to electrically connect the second node N2 and the fourth node N4 to each other. In an embodiment, the sixth transistor T6 may be turned off when the previous emission control signal of the previous emission control line EL[i−k] is not supplied. In such an embodiment, even though the emission control signal is supplied through the emission control line EL[i], the threshold voltage compensation of the first transistor T1 may be performed while maintaining a non-emission state of the light emitting element LD.

The seventh transistor T7 may be connected between the fourth node N4 corresponding to the first electrode of the light emitting element LD, and the initialization power source Vint. The seventh transistor T7 may include a gate electrode that receives the second scan signal. Therefore, the gate electrode of the seventh transistor T7 may be connected to the second scan line SL2[*i*] for supplying the second scan signal.

The seventh transistor T7 may be turned on when the second scan signal is supplied to the second scan line SL2[*i*] to initialize a voltage of the fourth node N4 (or voltage of the first electrode of the light emitting element LD) to the voltage of the initialization power source Vint.

In an embodiment, the transistors T1, T2, T3, T4, T5, T6, and T7 shown in FIG. 2 may be p-type transistors, e.g., p-channel metal oxide semiconductor ("PMOS") transistors. In one embodiment, for example, the transistors T1, T2, T3, T4, T5, T6, and T7 shown in FIG. 2 may be low-temperature poly-silicon ("LTPS") thin film transistors. However, the disclosure is not limited thereto, and alternatively, the transistors T1, T2, T3, T4, T5, T6, and T7 may be n-type transistors, e.g., n-channel metal oxide semiconductor ("NMOS") transistors.

Figure 3:
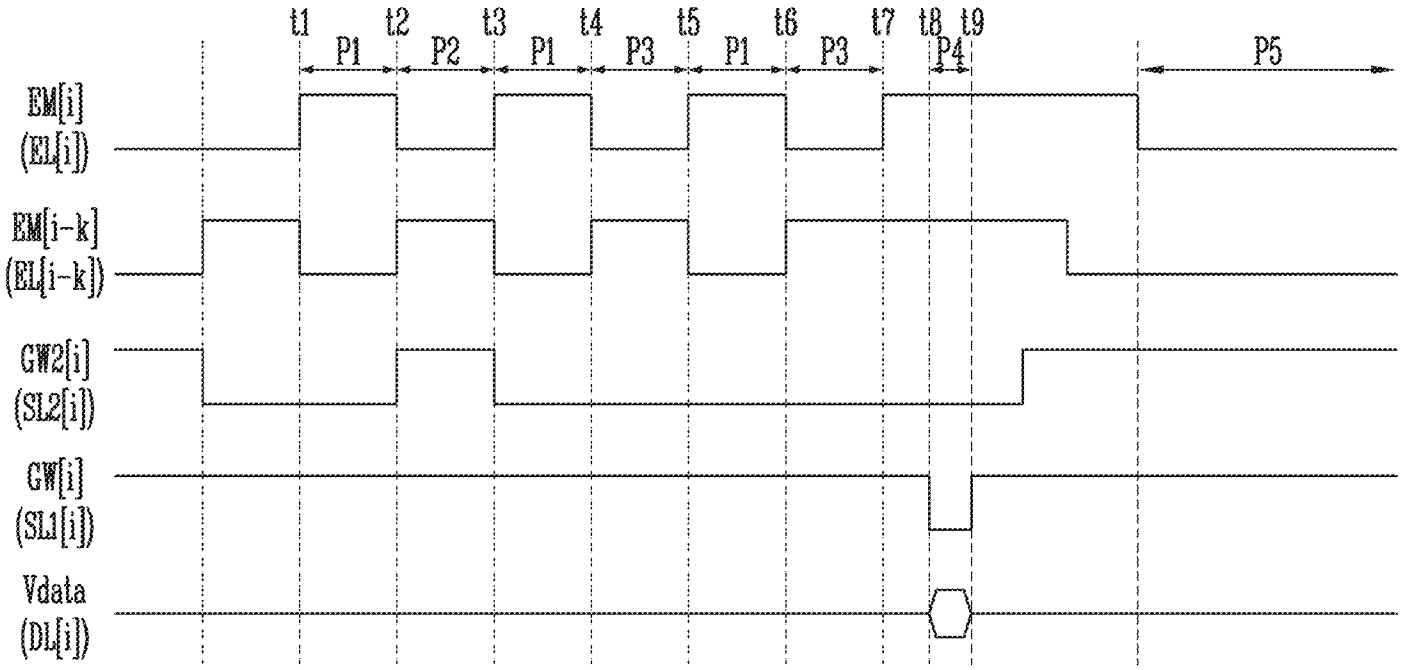
FIG. 3 is a signal timing diagram for describing an operation of the pixel of FIG. 2.
Figure 4:
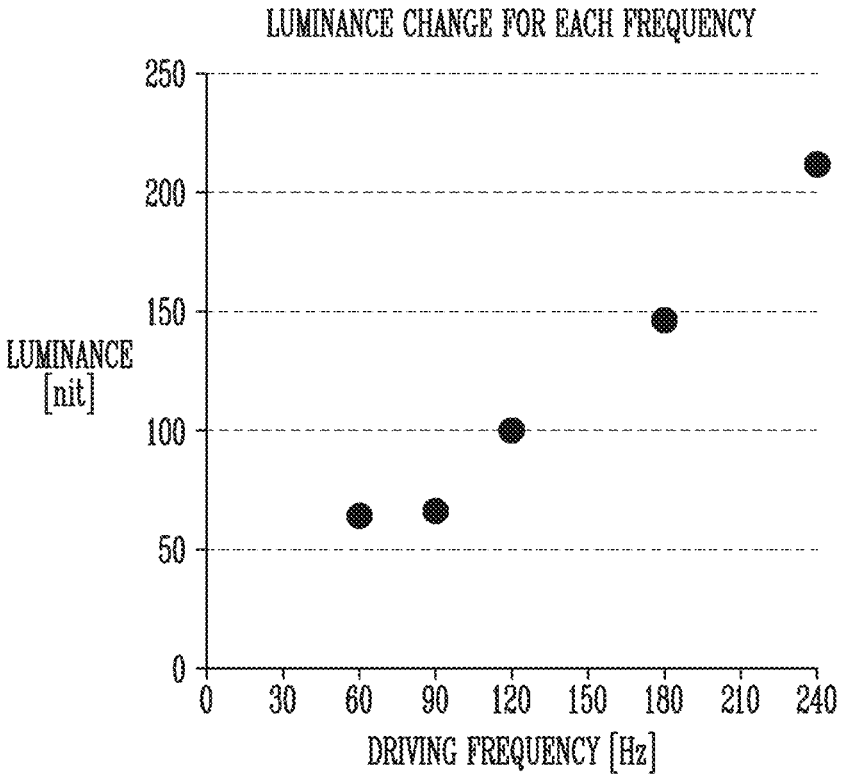
FIG. 4 is a graph illustrating a luminance change according to a driving frequency change of the display device.

FIG. 3 is a signal timing diagram for describing an operation of the pixel of FIG. 2. FIG. 4 is a graph illustrating a luminance change according to the driving frequency change of the display device.

Since the pixel PX[i, j] shown in FIG. 2 includes a p-type transistor, when signals EM[i], EM[i−k], GW[i], and GW2[*i*] in FIG. 3 are in high levels, the signals EM[i], EM[i−k], GW[i], and GW2[*i*] may have gate turn-off voltages, and when the signals EM[i], EM[i−k], GW[i], and GW2[*i*] in FIG. 3 are in low levels, the signals EM[i], EM[i−k], GW[i], and GW2[*i*] may have gate turn-on voltages. However, the disclosure is not limited thereto. In an alternative embodiment where the pixel PX[i, j] includes an n-type transistor, it may be reversed.

The timing diagram of FIG. 3 shows some waveforms of signals in one frame period. In addition, FIG. 3 shows the first scan signal GW[i] is supplied to the first scan line SL1[i], the second scan signal GW2[*i*] is supplied to the second scan line SL2[*i*], the emission control signal EM[i] is supplied to the emission control line EL[i], and the previous emission control signal EM[i−k] is supplied to the previous emission control line EL[i−k].

The pixel PX[i, j] may emit light in a period in which both of the emission control signal EM[i] and the previous emission control signal EM[i−k] are in gate-on levels (for example, a fifth period P5), and the pixel PX[i, j] (or the light emitting element LD) may not emit light in a period in which at least one of the emission control signal EM[i] and the previous emission control signal EM[i−k] is in a gate-off level (for example, a first period P1, a second period P2, a third period P3, a fourth period P4, and the like).

The second scan signal GW2[*i*] may include a period in which the second scan signal GW2[*i*] is in the gate-on level in a period in which the pixel PX[i, j] (or the light emitting element LD) does not emit light. In the period in which the second scan signal GW2[*i*] is in the gate-on level, the first electrode of the light emitting element LD and/or the gate electrode of the first transistor T1 may be initialized or the threshold voltage of the first transistor T1 may be compensated. In addition, the second scan signal GW2[*i*] may include a period in which the second scan signal GW2[*i*] is in the gate-off level (period overlapping P2), which overlaps a period in which the emission control signal is in the gate-on level.

In such an embodiment, in the period in which the second scan signal GW2[*i*] is in the gate-on level, a period, in which the previous emission control signal EM[i−k] has the gate-on level, may not overlap the period, in which the emission control signal EM[i] has the gate-on level, to maintain the non-emission state (or in order to prevent incorrect emission).

In an embodiment, at a first time point t1, as the emission control signal EM[i] transits from the gate-on level to the gate-off level, the fifth transistor T5 and the fourth transistor T4 may be turned off. In addition, as the previous emission control signal EM[i−k] transits from the gate-off level to the gate-on level, the sixth transistor T6 may be turned on at the first time point t1. In such an embodiment, as the second scan signal GW2[*i*] maintains the gate-on level, the seventh transistor T7 may be turned on. Therefore, in a period between the first time point t1 and a second time point t2, as the voltage of the initialization power source Vint is supplied to the fourth node N4 (or the first electrode of the light emitting element LD), the first electrode (or the anode electrode) of the light emitting element LD may be initialized. In addition, as the voltage of the initialization power source Vint supplied to the fourth node N4 is supplied to the first node N1 through the sixth transistor T6 and the third transistor T3, the gate electrode of the first transistor T1 (or the first node N1) may be initialized. That is, the period between the first time point t1 and the second time point t2 may be the first period P1 in which the first electrode of the light emitting element LD and the gate electrode of the first transistor T1 are initialized.

At the second time point t2, as the emission control signal EM[i] transits from the gate-off level to the gate on-level, the fourth transistor T4 and the fifth transistor T5 may be turned on. In addition, as the previous emission control signal EM[i−k] transits from the gate-on level to the gate-off level, the sixth transistor T6 may be turned off at the second time point t2. In addition, as the second scan signal GW2[*i*] transits from the gate-on level to the gate-off level, the third transistor T3 and the seventh transistor T7 may be turned off at the second time point t2. Therefore, the voltage of the first power source VDD may be supplied to the first electrode of the first transistor T1 through the fifth transistor T5. In addition, the voltage of the first power source VDD or the reference power source Vref may be supplied to the third node N3 through the fourth transistor T4. Accordingly, a period between the second time point t2 and a third time point t3 may be the second period P2 for removing on a bias deviation of the first transistor T1 generated due to a grayscale difference between adjacent frames and/or adjacent pixel rows.

At the third time point t3, as the emission control signal EM[i] transits from the gate-on level to the gate-off level, the fifth transistor T5 and the fourth transistor T4 may be turned off. In addition, as the previous emission control signal EM[i−k] transits from the gate off level to the gate on level, the sixth transistor T6 may be turned on at the third time point t3. In addition, as the second scan signal GW2[*i*] transits from the gate off level to the gate on level, the seventh transistor T7 may be turned on at the third time point t3. Therefore, a period between the third time point t3 and a fourth time point t4 may be the first period P1 in which the first electrode of the light emitting element LD and the gate electrode of the first transistor T1 are initialized, similarly to the period between the first time point t1 and the second time point t2.

At the fourth time point t4, as the emission control signal EM[i] transits from the gate-off level to the gate-on level, the fourth transistor T4 and the fifth transistor T5 may be turned on. In addition, as the previous emission control signal EM[i−k] transits from the gate-on level to the gate-off level, the sixth transistor T6 may be turned off. In addition, as the second scan signal GW2[*i*] is maintained as the gate-on level, a charge charged by the voltage of the first power source VDD supplied to the first electrode of the first transistor T1 may be supplied to the gate electrode of the first transistor T1 through the three transistors T3. Therefore, the threshold voltage of the first transistor T1 may be compensated. That is, a period between the fourth time point t4 and a fifth time point may be the third period P3 for compensating for the threshold voltage of the first transistor T1.

In such an embodiment, in the third period P3, the first transistor T1 may have a diode connection form. A voltage corresponding to the threshold voltage Vth of the first transistor T1 may be stored in the second capacitor C2. In addition, in the third period P3, the threshold voltage compensation may be performed by the voltage of the first power source VDD which is a constant voltage source. Therefore, since a threshold voltage compensation operation is performed based on a fixed or constant voltage rather than the data signal (data voltage) that may be changed according to the pixel row and/or frame, a change of a bias applied to the first transistor T1 is not large, and a hysteresis change of the first transistor T1 may be minimized.

Thereafter, a period between the fifth time point t5 and a sixth time point t6 may be the first period P1 in which the first electrode of the light emitting element LD and the gate electrode of the first transistor T1 are initialized. A period between the sixth time point t6 and a seventh time point t7 may be the third period P3 in which the threshold voltage of the first transistor T1 is compensated.

At an eighth time point t8, as the emission control signal EM[i] and the previous emission control signal EM[i−k] are maintained as the gate-off level, the fourth transistor T4, the fifth transistor T5 and the sixth transistor T6 may be turned off. In addition, as the second scan signal GW2[*i*] is maintained as the gate-on level, the third transistor T3 and the seventh transistor T7 may be turned on. At the eight time point t8, as the first scan signal GW[i] transits from the gate-off level to the gate-on level, the second transistor T2 may be turned on and the data voltage (or the data signal) supplied to the data line DL[j] may be transmitted to the third node N3. Therefore, the threshold voltage Vth and the voltage (data voltage) corresponding to the data signal may be stored in the first capacitor C1 and the second capacitor C2 according to a charge sharing principle, respectively. That is, a period between the eighth time point t8 and the ninth time point t9 may be the fourth period P4 in which the data signal is written to the pixel PX[i, j].

In the fifth period P5, as the emission control signal EM[i] and the previous emission control signal EM[i−k] become the gate-on level, the driving current may be supplied to the light emitting element LD through the sixth transistor T6 by the first transistor T1. Here, the driving current may be defined or determined based on Equation 1 described above.

In an embodiment, as described above, the pixel PX[i, j] shown in FIG. 2 may go through the first period P1 in which the first electrode of the light emitting element LD and the gate electrode of the first transistor T1 are initialized, and the second period P2 for removing the on bias deviation of the first transistor T1. In such an embodiment, the pixel PX[i, j] of FIG. 2 may further go through the fourth period P4 in which the data is written and the fifth period P5 in which the light emitting element LD emits light after repeating at least once the first period P1 and the third period P3 for compensating for the threshold voltage of the first transistor T1. In such an embodiment, in the period in which the second scan signal GW2[*i*] is in the gate-on level, the first period P1 and the third period P3 may be repeated twice or more times.

In an embodiment, as described above, the pixel PX[i, j] of FIG. 2 may compensate for the threshold voltage of the first transistor T1 using the voltage of the first power source VDD which is a constant voltage source. In such an embodiment, the on bias deviation of the first transistor T1 may be removed. In such an embodiment, the threshold voltage compensation operation (that is, the third period P3) of the first transistor T1 (that is, the driving transistor) and the data writing operation (that is, the fourth period P4) may be separated or performed separately from each other.

In an embodiment, the threshold voltage compensation period P3 may be effectively adjusted by adjusting a waveform of the emission control signal EM[i]. Therefore, a time for compensating for the threshold voltage of the display device DD operating at a high driving frequency may be ensured.

When the driving frequency of the display device DD increases, the third period P3 for compensating the threshold voltage of FIG. 3 may be reduced. When the third period P3 is reduced, since sufficient threshold voltage compensation is not performed, a current amount supplied to the light emitting element LD by the first transistor T1, which is a p-type transistor, may increase, and thus a luminance may increase. Specifically, referring to FIG. 4, as the driving frequency of the display device DD increases, the luminance of the light emitting element LD may increase.

Therefore, a period in which the emission control signal EM[i] that controls the third period P3 has the gate-on level is desired to be maintained more longer or sufficiently long to ensure a sufficient threshold voltage compensation time even at a high driving frequency, e.g., 240 hertz (Hz).

In addition, the period in which the emission control signal EM[i] has the gate-on level and the period in which the previous emission control signal EM[i−k] has the gate-on level may be controlled not to overlap each other to prevent incorrect emission. At this time, when the period in which the emission control signal EM[i] is has the gate-on level is adjusted based on the driving frequency, the period in which the previous emission control signal EM[i−k] has the gate-on level may not be effectively controlled to allow the period in which the previous emission control signal EM[i−k] has the gate-on level not to overlap the period in which the emission control signal EM[i] has the gate-on level. Therefore, the period in which the previous emission control signal EM[i−k] has the gate-on level is desired to be controlled independently.

Figure 5:
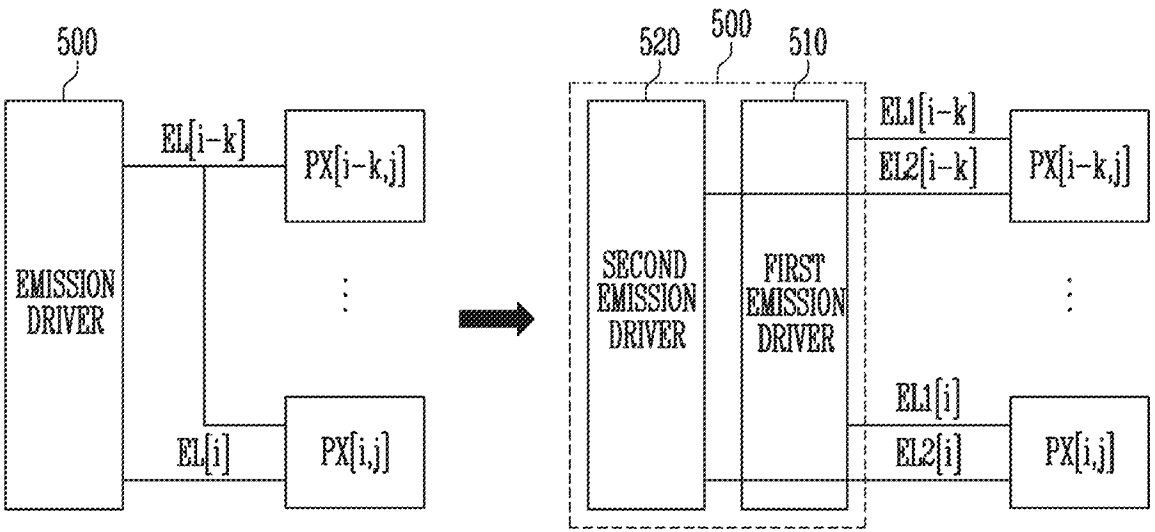
FIG. 5 is a conceptual diagram for describing a line of an emission driver according to an embodiment of the disclosure.

FIG. 5 is a conceptual diagram for changing a line of the emission driver according to an embodiment of the disclosure.

Referring to the left figure of FIG. 5, in an embodiment, a line of the previous emission control line EL[i−k] may be branched and connected to a current pixel PX[i, j]. In such an embodiment have the line connection state described above, when the emission control signal supplied to the emission control line EL[i] of the current pixel PX[i, j] is adjusted according to the driving frequency change, the previous emission control signal supplied from the previous emission control line EL[i−k] may also be changed.

Therefore, in such an embodiment, the period in which the previous emission control signal EM[i−k] has the gate-on level may not be effectively controlled to allow the period in which the previous emission control signal EM[i−k] has the gate-on level not to overlap the period in which the emission control signal EM[i] has the gate-on level.

Referring to the right figure of FIG. 5, in an embodiment, the emission driver 500 may include a first emission driver 510 and a second emission driver 520. In such an embodiment, the first emission driver 510 may supply a first emission control signal to the pixel PX[i, j] through a first emission control line EL1[*i*], and the second emission driver 520 may supply a second emission control signal to the pixel PX[i, j] through a second emission control line EL2[*i*].

In such an embodiment, the first emission control line EL1[*i*] and the first emission control signal may be the same as the emission control line EL[i] and the emission control signal shown in the left figure of FIG. 5, respectively. In such an embodiment, the second emission control line EL2[*i*] and the second emission control signal may be the same as the previous emission control line EL[i−k] and the previous emission control signal shown in the left figure of FIG. 5, respectively.

In such an embodiment, as described above, instead of branching the line of the previous emission control line EL[i−k], when the separate second emission driver 520 independently supplies the second emission control signal to the pixel PX [i, j] through the second emission control line EL2 [i], the period in which the second emission control signal has the gate on level may be effectively controlled to allow the period in which the second emission control signal has the gate-on level not to overlap the period in which the first emission control signal has the gate on level.

Figure 6:
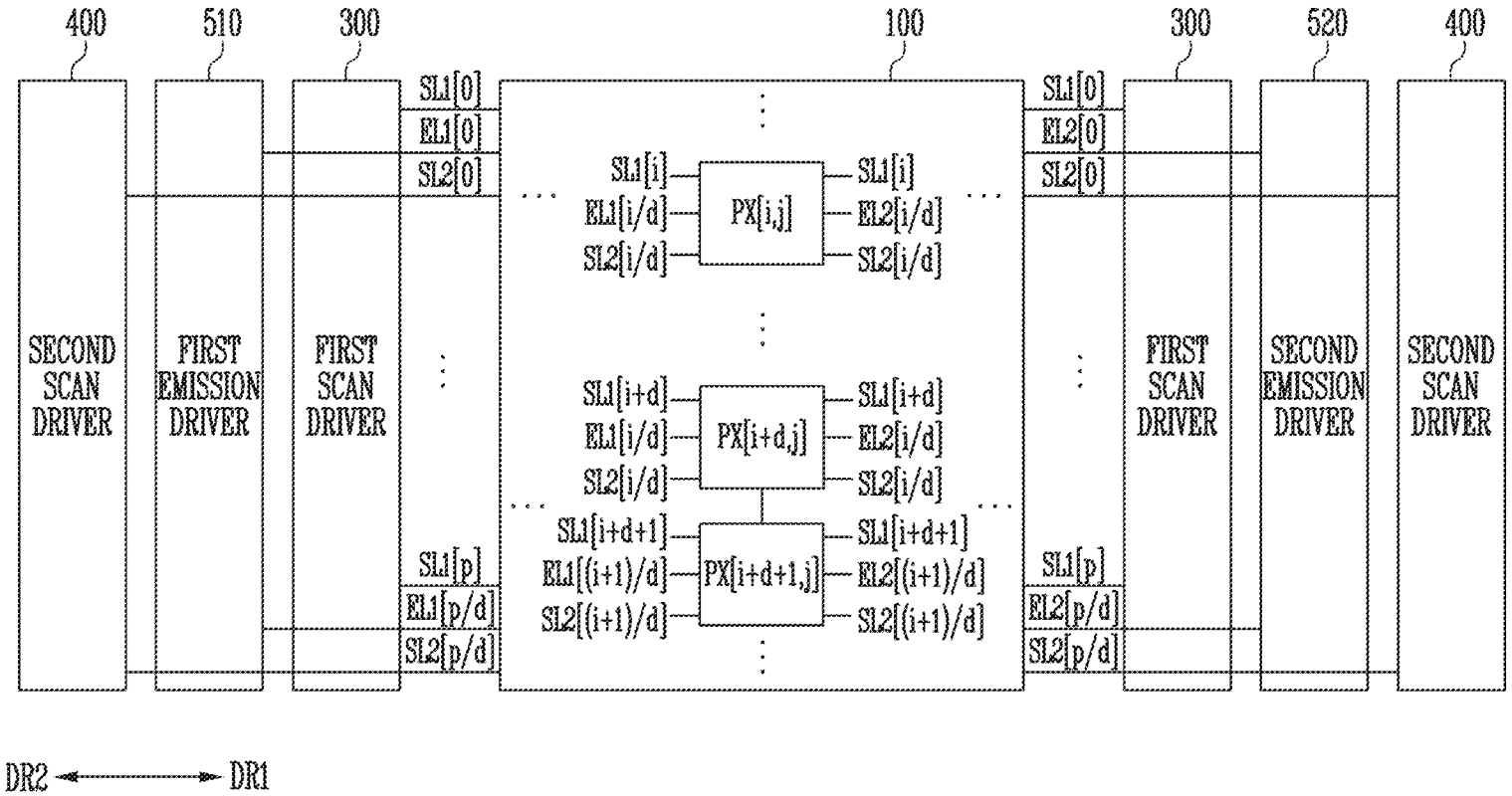
FIG. 6 is a block diagram illustrating the display device according to an alternative embodiment of the disclosure.

FIG. 6 is a block diagram illustrating the display device according to an alternative embodiment of the disclosure.

As shown in the right figure of FIG. 5, in an embodiment, where the emission driver 500 includes the first emission driver 510 and the second emission driver 520, the first scan driver 300, the second scan driver 400, the emission driver 510 and the second emission driver 520 may be disposed based on the display panel 100 as shown in FIG. 6.

In FIG. 6, a first direction DR1 may be a direction corresponding to a horizontal line on which the pixels are arranged, and a second direction DR2 may be a direction opposite to the first direction DR1.

Referring to FIG. 6, the first scan driver 300 may be located in the first direction DR1 and the second direction DR2 (or opposing sides) based on the display panel 100. That is, the first scan driver 300 may be located in the first direction DR1 and the second direction DR2 based on the pixel PX[i, j] located in the i-th row of the display panel 100, respectively, and may operate in two side driving.

Similarly to the first scan driver 300, the second scan driver 400 may be located in the first direction DR1 and the second direction DR2 (or opposing sides) based on the display panel 100. That is, the second scan driver 400 may be located in the first direction DR1 and the second direction DR2 based on the pixel PX[i, j] located in the i-th row of the display panel 100, respectively, and may operate in two side driving.

The first emission driver 510 may be located in the second direction DR2 based on the display panel 100. That is, the first emission driver 510 may be located in the second direction DR2 based on the pixel PX[i, j] located in the i-th row of the display panel 100 and may operate in single side driving.

The second emission driver 520 may be located in the first direction DR1 based on the display panel 100. That is, the second emission driver 520 may be located in the first direction DR1 based on the pixel PX[i, j] located in the i-th row of the display panel 100 and may operate in single side driving.

In an embodiment, each of the first scan driver 300, the second scan driver 400, the first emission driver 510, and the second emission driver 520 may be mounted on a substrate through a thin film process.

The first scan driver 300 may supply respective first scan signals (by shifting the first scan signals) in a row unit in which pixels PX[i, j], PX[i+d, j], and PX[i+d+1, j] of the display panel 100 are arranged. In one embodiment, for example, the first scan line SL1[*i*] corresponding to the i-th row may be connected to the pixel PX[i, j] located in the i-th row of the display panel, and the first scan signal may be supplied through the connected first scan line SL1[*i*]. In addition, a first scan line SL1[*i*+d] corresponding to an (i+d)-th row may be connected to the pixel PX[i+d, j], and the first scan signal may be supplied through the connected first scan line SL1[*i*+d].

The second scan driver 400 may simultaneously supply the second scan signal to the pixels PX[i, j], PX[i+d, j], and PX[i+d+1, j] arranged in two or more successive rows of the display panel 100. In one embodiment, for example, the second scan driver 400 may simultaneously supply the same second scan signal to from the pixels PX [i, j] located in the i-th row to the pixels PX [i+d, j] located in the (i+d)-th row (d is a natural number). That is, the second scan driver 400 may supply the second scan signal by shifting the second scan signal in two or more row units in which the pixels PX[i, j], PX[i+d, j], and PX[i+d+1, j] of the display panel 100 are located, and the pixels may share the same second scan signal in the two or more row units. In addition, from the pixels PX [i, j] located in the i-th row to the pixels PX [i+d, j] located in the (i+d)-th row may be connected to the same second scan line (SL2[*i/d*]). In such an embodiment, the number of stages in the second scan driver 400 may be less than the number of stages in the first scan driver 300.

The first emission driver 510 may simultaneously supply the first emission control signal to the pixels PX[i, j], PX[i+d, j], and PX[i+d+1] located in two or more successive rows of the display panel 100. In one embodiment, for example, the first emission driver 510 may simultaneously supply the first emission control signal from the pixels PX [i, j] located in the i-th row to the pixels PX [i+d, j] located in the (i+d)-th row (d is a natural number). That is, the first emission driver 510 may supply the first emission control signal by shifting the first emission control signal in two or more row units in which the pixels PX[i, j], PX[i+d, j], and PX[i+d+1, j] of the display panel 100 are located, and the pixels may share the same first emission control signal in the two or more row units. In addition, from the pixels PX [i, j] located in the i-th row to the pixels PX [i+d, j] located in the (i+d)-th row may be connected to the same first emission control line (EL1[*i/d*]). In such an embodiment, the number of stages in the first emission driver 510 may be less than the number of stages in the first scan driver 300.

The second emission driver 520 may simultaneously supply the second emission control signal (or the current emission control signal) to the pixels PX[i, j], PX[i+d, j], and PX[i+d+1] located in two or more successive rows of the display panel 100. In one embodiment, for example, the second emission driver 520 may simultaneously supply the second emission control signal from the pixels PX [i, j] located in the i-th row to the pixels PX [i+d, j] located in the (i+d)-th (d is a natural number) row. That is, the second emission driver 520 may supply the second emission control signal by shifting the second emission control signal in two or more row units in which the pixels PX[i, j], PX[i+d, j], and PX[i+d+1, j] of the display panel 100 are located, and the pixels may share the same second emission control signal in the two or more row units. In addition, from the pixels PX [i, j] located in the i-th row to the pixels PX [i+d, j] located in the (i+d)-th row may be connected to the same second emission control line (EL2[*i/d*]). In such an embodiment, the number of stages in the second emission driver 520 may be less than the number of stages in the first scan driver 300.

In an embodiment, as described above, the pixels located in two or more successive rows may be commonly controlled by a same first emission control signal. The pixels located in two or more successive rows may be commonly controlled by a same second emission control signal. The pixels located in two or more successive rows may be commonly controlled by a same second scan signal. In such an embodiment, the respective first scan signals may be shifted and supplied in a row unit in which the pixels are located in the display panel 100. Therefore, the display device DD operating at a high driving frequency (e.g., 120 Hz or greater) may be easily implemented.

The connection relationship shown in FIG. 6 and described above are merely exemplary, and alternatively, all of the first emission control signal, the second emission control signal, the first scan signal, and the second scan signal may be shifted in a row unit and may be sequentially supplied to the pixels located in each row.

Figure 7:
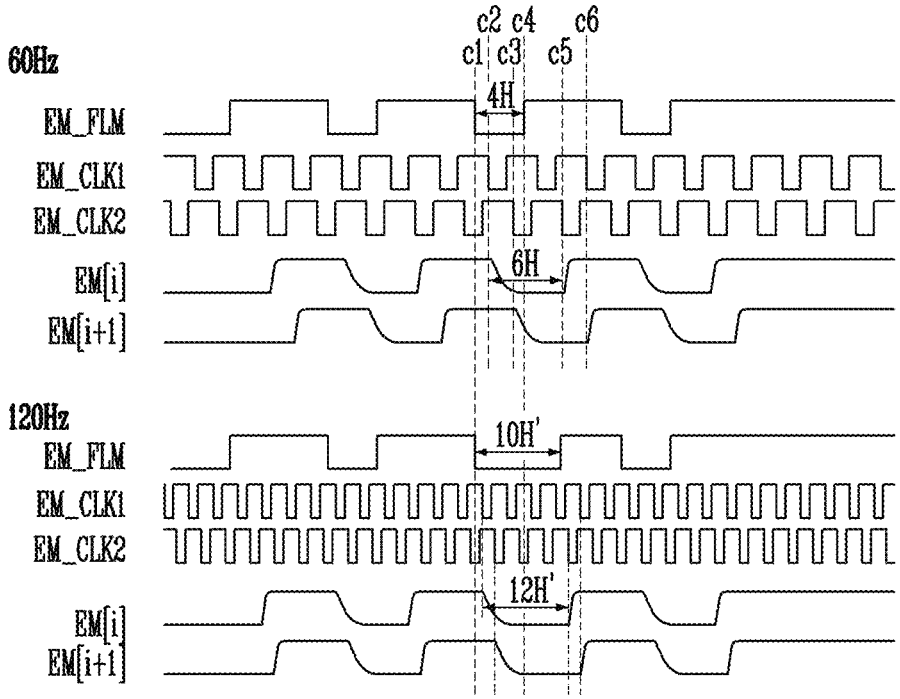
FIG. 7 is a signal timing diagram illustrating an emission control signal according to the driving frequency change in the display device according to an embodiment of the disclosure.

FIG. 7 is a signal timing diagram illustrating the emission control signal according to the driving frequency change in the display device according to an embodiment of the disclosure.

In an embodiment, an emission start signal EM_FLM is included in the third control signal ECS provided to the emission driver 500 by the timing controller 200 of the display device DD of FIG. 1. When the emission start signal EM_FLM is supplied to the emission driver 500, the emission control signal may be sequentially shifted and output from each stage circuit of the emission driver 500 based on clock signals EM_CLK1 and EM_CLK2.

In FIG. 7, the emission start signal EM_FLM, the first clock signal EM_CLK1, and the second clock signal EM_CLK2 are defined as being supplied when the levels thereof are at a low level. FIG. 7 shows an emission control signal EM[i] of an i-th stage circuit (i is a natural number) among the stage circuits of the emission driver 500 and an emission control signal EM[i+1] of an (i+1)-th stage circuit, however, the emission start signal EM_FLM, the first clock signal EM_CLK1, and the second clock signal EM_CLK2 may be variously modified according to a type and a configuration of the stage circuits in the emission driver 500.

Referring to FIG. 7, an operation of the emission driver 500 in the display device DD when the driving frequency is 60 Hz will hereinafter be described in detail.

In an embodiment, at a first time point c1, the emission start signal EM_FLM is supplied to the emission driver 500. At a second time point c2 after the first time point c1, when the first clock signal EM_CLK1 is supplied, the emission control signal EM[i] from the i-th stage circuit may be supplied to the pixels (for example, the pixels corresponding to the i-th row).

At a third time point c3, when the second clock signal EM_CLK2 is supplied, the emission control signal EM[i+1] from the (i+1)-th stage circuit may be applied to the pixels (for example, the pixels corresponding to the (i+1)-th row). In such an embodiment, the emission control signal EM[i+1] supplied from the (i+1)-th stage circuit may be a signal which is shifted from the emission control signal EM[i] supplied from the i-th stage circuit (by a period between the second time point c2 and the third time point c3).

At a fourth time point c4, when supply of the emission start signal EM_FLM is stopped, supply of the emission control signal EM[i] output from the i-th stage circuit at a fifth time point c5 at which the second clock signal EM_CLK2 is supplied after the fourth time point c4 is stopped.

At a sixth time point c6 after the fifth time point c5, at which supply of the first clock signal EM_CLK1 is stopped, supply of the emission control signal EM[i+1] output from the (i+1)-th stage circuit is stopped.

In such an embodiment, when the emission start signal EM_FLM is supplied by 4H (H is a first horizontal period) at a driving frequency 60 Hz, the emission control signal EM[i] of the i-th stage circuit is supplied by 6H.

When the driving frequency of the display device DD is increased from 60 Hz to 120 Hz, cycles of the first clock signal EM_CLK1 and the second clock signal EM_CLK2 are reduced by half. Therefore, if the emission start signal EM_FLM is supplied by 4H when the driving frequency is 120 Hz, as in a case where the driving frequency is 60 Hz, a supply period of the emission control signal EM[i] supplied by the i-th stage circuit is reduced by a period longer than 6H. That is, since the supply period of the emission control signal decreases as the driving frequency increases, the period for compensating for the threshold voltage of the driving transistor (first transistor T1 of FIG. 2) decreases.

In an embodiment of the disclosure, the supply period of the emission start signal EM_FLM supplied by the timing controller 200 may increase based on the driving frequency to sufficiently ensure (or maintain to be constant) the period for compensating for the threshold voltage even though the driving frequency is increased.

In one embodiment, for example, referring to FIG. 7 where the driving frequency of the display device DD is 120 Hz, the supply period of the emission control signal EM[i] may be 12H' (H' is a second horizontal period in which an absolute time is less than that of the first horizontal period (1H). In one embodiment, for example, H' may satisfy of the following equation: 2H'=H. In such an embodiment, the supply period of the emission start signal EM_FLM may be increased to supply the emission start signal EM_FLM during 10H' in comparison with a case where the driving frequency is the 60 Hz. In such an embodiment, as shown in FIG. 7, the supply period 10H' of the emission start signal EM_FLM when the driving frequency is 120 Hz may be greater than the supply period 4H of the emission start signal EM_FLM when the driving frequency is 60 Hz.

In an embodiment, as described above, when the supply period of the emission start signal EM_FLM is increased as the driving frequency increases, the supply period of the emission control signal EM[i] may be relatively maintained to be constant. In one embodiment, for example, as shown in FIG. 7, the supply period 6H of the emission control signal when the driving frequency is 60 Hz and the supply period 12H' of the emission control signal when the driving frequency is 120 Hz may be the same or similar to each other.

Therefore, as the driving frequency increases from 60 Hz to 120 Hz or 240 Hz, when the period in which the emission start signal EM_FLM is supplied is increased, the supply period of the emission control signal EM[i] may be maintained to be constant, and thus the period for compensating for the threshold voltage may be ensured.

Figure 8:
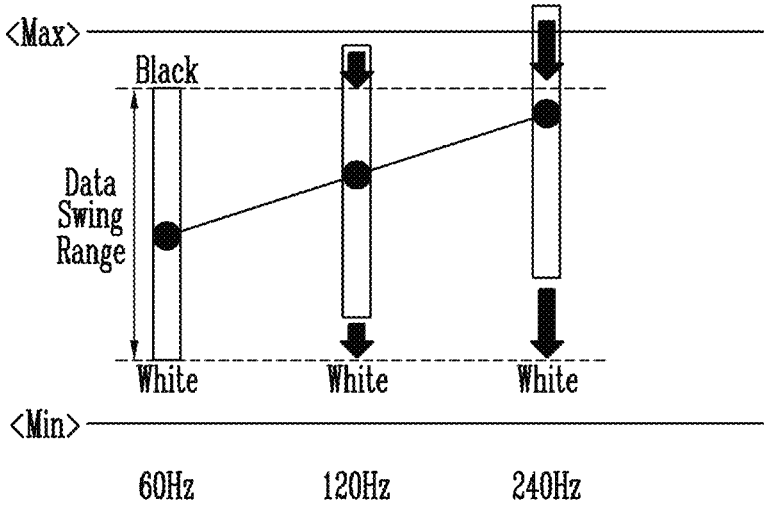
FIG. 8 is a diagram illustrating a range of a data voltage according to the driving frequency change according to an embodiment of the disclosure.

FIG. 8 is a diagram illustrating a range of the data voltage according to the driving frequency change according to an embodiment of the disclosure.

As described above, when the driving frequency is increased, a luminance value may gradually increases as shown in FIG. 4 if the period for compensating for the threshold voltage is decreased. Therefore, even though the luminance value is increased, a swing range (data swing range) of the data voltage corresponding to each grayscale value is desired to be gradually increased to ensure seamless driving of the display device DD, as shown in FIG. 8.

However, if the swing range of the data voltage gradually increases as the driving frequency increases, power consumption of the display device DD may increase since the data voltage for expressing each grayscale value increases.

However, as described above with reference to FIG. 7, in an embodiment where the timing controller 200 increases the supply period of the emission start signal EM_FLM according to the driving frequency increase of the display device DD to ensure the period for compensating for the threshold voltage, even though the driving frequency is increased, a luminance value increase may be suppressed, and power consumption increase may be prevented by not increasing the swing range of the data voltage.

In such an embodiment, where the supply period of the emission start signal EM_FLM is appropriately adjusted according to the driving frequency change, the swing range (data swing range) of the data voltage may be set to a targeted range.

Figure 9:
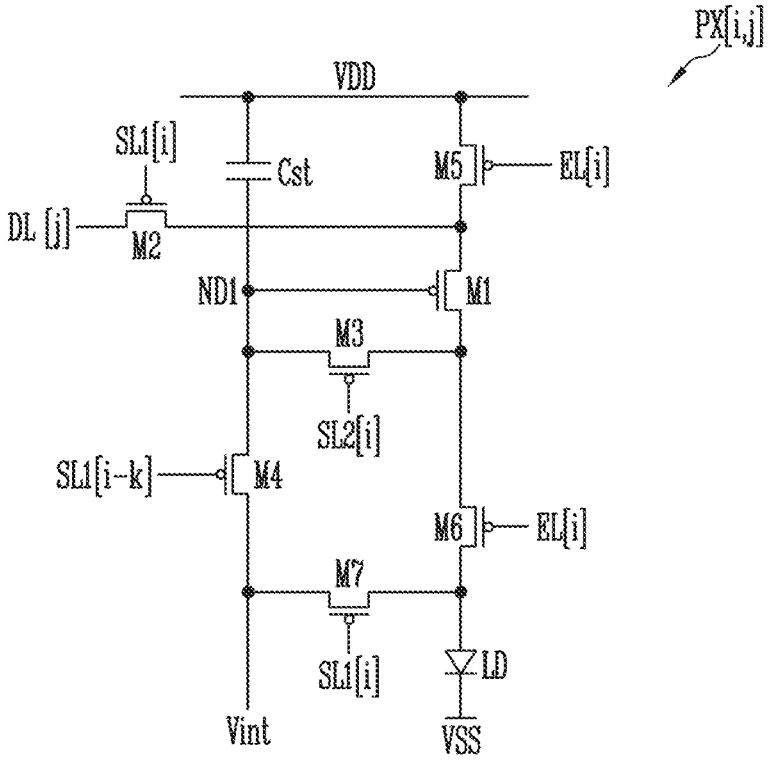
FIG. 9 is a circuit diagram illustrating the pixel according to an alternative embodiment of the disclosure.

FIG. 9 is a circuit diagram illustrating the pixel according to an alternative embodiment of the disclosure.

In an embodiment, as described above with reference to FIG. 2, the pixel may have a structure that compensates for the threshold voltage of the driving transistor (first transistor T1 of FIG. 2) by using the first power source VDD that is a constant voltage source.

In an alternative embodiment of the disclosure, as shown in FIG. 9, a pixel circuit for compensating for the threshold voltage of the driving transistor may use the data voltage (or the data signal) supplied through the data line.

Similarly to FIG. 2, for convenience of illustration and description, FIG. 9 shows the pixel PX[i, j] located in the i-th row (or horizontal line) and the j-th column, but other pixels may have a same pixel structure as the pixel PX[i, j]. In FIG. 9, as in the display device DD shown in FIG. 1, the first scan line SL1[*i*] from the first scan driver 300 may be connected to the pixel PX[i, j], the second scan line SL2[*i*] from the second scan driver 400 may be connected to the pixel PX[i, j], and the emission control line EL[i] from the emission driver 500 may be connected to the pixel PX[i, j].

Referring to FIG. 9, the pixel PX[i, j] may include a light emitting element LD, first to seventh transistors M1 to M7, and a storage capacitor Cst.

In an embodiment, the light emitting element LD may include a first electrode electrically connected to a second electrode (for example, a drain electrode) of the first transistor M1 and a second electrode connected to a second power source VSS. In such an embodiment, the first electrode of the light emitting element LD may be electrically connected to the second electrode of the first transistor M1 through the sixth transistor M6.

The first transistor T1 may include a first electrode electrically connected to the first power source VDD, the second electrode electrically connected to the first electrode of the light emitting element LD, and a gate electrode connected to a first node ND1. In such an embodiment, the first electrode of the first transistor T1 may be connected to the first power source VDD through the fifth transistor T5. The second electrode of the first transistor T1 may be connected to the light emitting element LD through the sixth transistor T6. The first transistor T1 may supply the driving current to the light emitting element LD. The first transistor T1 may function as a driving transistor of the pixel. That is, the first transistor T1 may control the current amount flowing from the first power source VDD to the second power source VSS via the light emitting element LD in correspondence with a voltage applied to the first node ND1.

The storage capacitor Cst may be connected between the first power source VDD and the first node ND1 corresponding to the gate electrode of the first transistor T1. The storage capacitor Cst may be charged with a differential voltage between the voltage of the first power source VDD and the voltage of the first node ND1.

The second transistor M2 may be connected between the data line DL[j] and the first electrode of the first transistor T1. The second transistor M2 may include a gate electrode that receives the first scan signal. In one embodiment, for example, the gate electrode of the second transistor M2 may be connected to the first scan line SL1[*i*]. The second transistor M2 may be turned on when the first scan signal is supplied to the first scan line SLIM to electrically connect the data line DL[j] and the first electrode of the first transistor T1 to each other. Therefore, the data voltage (or data signal) supplied to the data line DL[j] may be transferred to the first electrode of the first transistor T1.

In such an embodiment, when the second transistor M2 is turned on in correspondence with the first scan signal supplied to the first scan line SL1[*i*], the data signal supplied through the data line DL[j] may be written to the pixel PX[i, j], and a differential voltage between the voltage of the first power source VDD and the data voltage may be stored in the storage capacitor Cst.

The third transistor M3 may be connected between the first node ND1 and the second electrode of the first transistor T1. The third transistor T3 may include a gate electrode that receives the second scan signal. In one embodiment, for example, the gate electrode of the third transistor M3 may be connected to the second scan line SL2[*i*]. The third transistor M3 may be turned on when the second scan signal is supplied to the second scan line SL2[*i*] to electrically connect the first node ND1 and the second electrode of the first transistor T1 to each other. When the first node ND1 and the second electrode of the first transistor T1 are electrically connected to each other, the first transistor T1 may have a form equivalent to a diode or become a diode-connected transistor. When the first transistor T1 has the form equivalent to the diode, a threshold voltage of the first transistor T1 may be compensated by a charge charged in the first electrode of the first transistor T1. In such an embodiment, since the data voltage through the data line DL[j] is supplied to the first electrode of the first transistor M1 through the second transistor M2, the threshold of the first transistor M1 may be compensated by the data voltage.

The fourth transistor M4 may be connected between the first node ND1 and the initialization power source Vint. The fourth transistor M4 may include a gate electrode that receives a previous first scan signal. The gate electrode of the fourth transistor M4 may be connected to a previous first scan line SL1[*i*−1]. The fourth transistor M4 may be turned on when the previous first scan signal is supplied to the previous first scan line SL1[*i*−1] to supply the voltage of the initialization power source Vint to the first node ND1. Therefore, the voltage of the first node ND1 may be initialized to the voltage of the initialization power source Vint.

The previous first scan signal may be a first scan signal corresponding to an (i−k)-th pixel row (k is a natural number, for example, k is 1). Therefore, the previous first scan line SL1[*i*−*k*] may be a line branched from the first scan line corresponding to the (i−k)-th pixel row. However, the disclosure is not limited thereto. In an alternative embodiment, as in the emission driver 500 of FIG. 5, the previous first scan line SL1[*i*−*k*] may be a line provided independently or separately (or disconnected) from the first scan line corresponding to the (i−k)-th pixel row. In one embodiment, for example, the first scan driver 300 may include a first sub scan driver that supplies the above-described first scan signal (for example, the first scan signal corresponding to an i-th pixel row) to a pixel (for example, a pixel located in an i-th row) and a second sub scan driver that supplies the previous first scan signal (for example, the first scan signal corresponding to the (i−k)-th pixel row) to a pixel (for example, the pixel located in the i-th row).

The fifth transistor M5 may be connected between the first power source VDD and the first electrode of the first transistor M1. The fifth transistor M5 may include a gate electrode that receives the emission control signal. In one embodiment, for example, the gate electrode of the fifth transistor M5 may be connected to the emission control line EL[i]. The fifth transistor M5 may be turned on when the emission control signal is supplied through the emission control line EL[i] to connect the first electrode of the first transistor M1 to the first power source VDD.

The sixth transistor M6 may be connected between the second electrode of the first transistor T1 and the first electrode of the light emitting element LD. The sixth transistor M6 may include a gate electrode that receives the emission control signal. In one embodiment, for example, the gate electrode of the sixth transistor M6 may be connected to the emission control line EL[i].

The sixth transistor M6 may be turned on when the emission control signal is supplied to the emission control line EL[i] to electrically connect the second electrode of the first transistor T1 and the first electrode of the light emitting element LD to each other.

The seventh transistor M7 may be connected between the first electrode of the light emitting element LD and the initialization power source Vint. The seventh transistor T7 may include a gate electrode that receives the first scan signal. Therefore, the gate electrode of the seventh transistor M7 may be connected to the first scan line SL1[*i*] that supplies the first scan signal.

The seventh transistor M7 may be turned on when the first scan signal is supplied to the first scan line SL1[*i*] to initialize the first electrode of the light emitting element LD to the voltage of the initialization power source Vint.

In an embodiment, the transistors T1, T2, T3, T4, T5, T6, and T7 shown in FIG. 9 may be p-type transistors, e.g., PMOS transistors. In one embodiment, for example, the transistors T1, T2, T3, T4, T5, T6, and T7 shown in FIG. 9 may be LTPS thin film transistors. However, the disclosure is not limited thereto, and the transistors T1, T2, T3, T4, T5, T6, and T7 may be n-type transistors, e.g., NMOS transistors.

Figure 10:
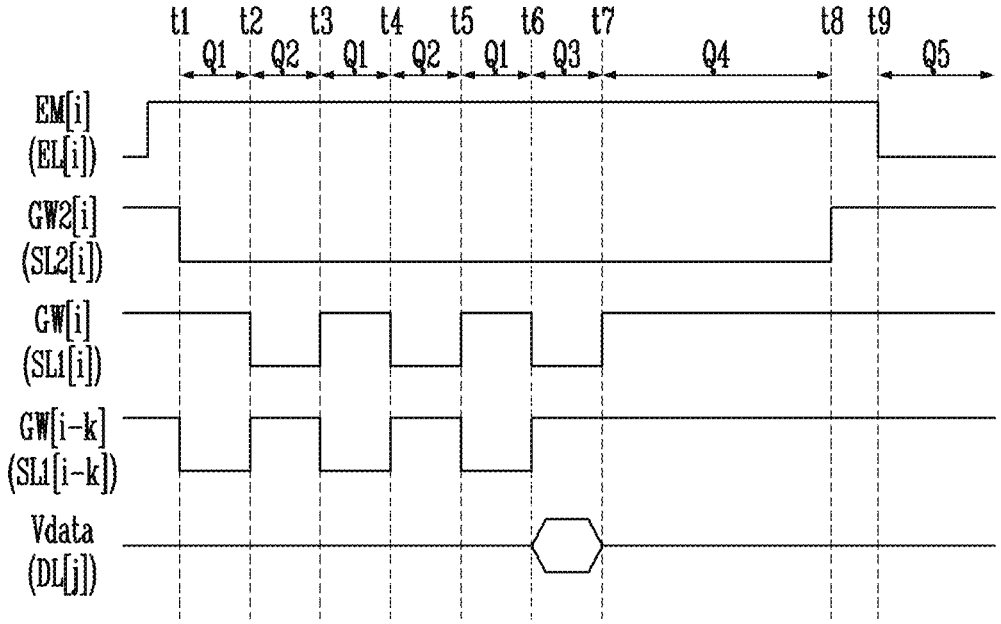
FIG. 10 is a signal timing diagram for describing an operation of the pixel of FIG. 9.

FIG. 10 is a signal timing diagram for describing an operation of the pixel of FIG. 9.

Since the pixel PX[i, j] shown in FIG. 9 is configured of a p-type transistor, when signals EM[i], EM[i−k], GW[i], and GW2[*i*] of FIG. 10 are in high levels, the signals EM[i], EM[i−k], GW[i], and GW2[*i*] may have gate turn-off voltages, and when the signals EM[i], EM[i−k], GW[i], and GW2[*i*] of FIG. 10 are in low levels, the signals EM[i], EM[i−k], GW[i], and GW2[*i*] may have gate turn-on voltages. However, the disclosure is not limited thereto. In an alternative embodiment where the pixel PX[i, j] includes an n-type transistor, it may be reversed.

The timing diagram of FIG. 10 shows some waveforms of signals in one frame period. In addition, FIG. 10 shows that the first scan signal GW[i] is supplied to the first scan line SL1[*i*], the second scan signal GW2[*i*] is supplied to the second scan line SL2[*i*], the emission control signal EM[i] is supplied to the emission control line EL[i], and the previous first scan signal GW[i−k] is supplied to the previous first scan line SL1[*i*−*k*].

The pixel PX[i, j] may emit light in a period in which the emission control signal EM[i] is in a gate-on level (for example, a fifth period Q5), and the pixel PX[i, j] may not emit light in a period in which the emission control signal EM[i] is in a gate-off level (for example, a first period Q1, a second period Q2, a third period Q3, a fourth period Q4, and the like).

The second scan signal GW2[*i*] may include a period in which the second scan signal GW2[*i*] is in the gate-on level in a period in which the pixel PX[i, j] does not emit light. In the period in which the second scan signal GW2[*i*] is in the gate-on level, the first electrode of the light emitting element LD and/or the gate electrode of the first transistor T1 may be initialized or the threshold voltage of the first transistor T1 may be compensated.

In such an embodiment, in the period in which the second scan signal GW2[*i*] is in the gate-on level, a period in which the first scan signal GW[i] has a gate-on level and a period in which the previous scan signal GW[i−1] has a gate-on level may not overlap each other.

In an embodiment, as shown in FIG. 10, at a first time point t1, as the second scan signal GW2[*i*] transits from the gate-off level to the gate-on level, the third transistor M3 may be turned on. At the first time point t1, as the previous first scan signal GW[i−k] transits from the gate-off level to the gate-on level, the fourth transistor M4 may be turned on. Therefore, as the voltage of the initialization power source Vint is supplied to the first node ND1 corresponding to the gate electrode of the first transistor M1 (or the driving transistor), the gate electrode of the first transistor M1 may be initialized. The period between the first time point t1 and a second time point t2 may be the first period Q1 for initializing the gate electrode of the first transistor M1. In one embodiment, for example, the first period Q1 may be the same as one horizontal period 1H.

At a second time point t2, as the first scan signal GW[i] transits from the gate-off level to the gate-on level, the second transistor M2 and the seventh transistor M7 may be turned on. As the second transistor M2 is turned on, off bias deviation of the first transistor M1 may be removed. In addition, as the seventh transistor M7 is turned on, the voltage of the initialization power source Vint is supplied to the first electrode of the light emitting element EL, and thus, the first electrode (or anode electrode) of the light emitting element EL may be initialized to the voltage of this initialization power source Vint. A period between the second time point t2 and a third time point t3 may be the second period Q2 in which the first electrode of the light emitting element EL is initialized and the off bias deviation of the first transistor M1 is removed.

At the third time point t3, as the previous first scan signal GW[i−k] transits from the gate-off level to the gate-on level, the fourth transistor M4 may be turned on. Therefore, as the voltage of the initialization power source Vint is supplied to the first node ND1 corresponding to the gate electrode of the first transistor M1, the gate electrode of the first transistor M1 may be initialized. A period between the third time point t3 and a fourth time point t4 may be the first period Q1 for initializing the gate electrode of the first transistor M1.

At the fourth time point t4, as the first scan signal GW[i] transits from the gate-off level to the gate-on level, the second transistor M2 and the seventh transistor M7 may be turned on. Therefore, similarly to the period between the second time point t2 and the third time point t3, a period between the fourth time point t4 and a fifth time point t5 may be the second period Q2 in which the first electrode of the light emitting element EL is initialized and the off bias deviation of the first transistor M1 is removed.

Similarly to the period between the first time point t1 and the second time point t2, a period between the fifth time point t5 and a sixth time point t6 may be the first period Q1 for initializing the gate electrode of the first transistor M1.

At a sixth time point t6, as the first scan signal GW[i] transits from the gate-off level to the gate-on level, the second transistor M2 and the seventh transistor M7 may be turned on. As the seventh transistor M7 is turned on, a data voltage Vdata may be transferred to the first electrode of the first transistor M1. In addition, since the second scan signal GW2[*i*] maintains the gate-on level, the first transistor M1 maintains an equivalent form with a diode as the third transistor M3 maintains a turn-on state. Therefore, the threshold voltage of the first transistor M1 may be compensated for using the data voltage Vdata transferred to the first electrode of the first transistor M1. In addition, data may be written to the pixel PX[i, j] by the data voltage Vdata transferred through the data line DL[j]. A period between the sixth time point t6 and a seventh time point t7 may be the third period Q3 in which the threshold voltage of the first transistor M1 is compensated and the data is written to the pixel PX[i, j].

At a seventh time point t7, since the first scan signal GW[i] and the previous first scan signal GW[i−k] are in the gate-off levels, data writing and initialization of the light emitting element LD are not performed. However, during the period between the sixth time point t6 and the seventh time point t7, the threshold voltage of the first transistor M1 may be further compensated using a charge charged by the data voltage Vdata supplied to the first electrode of the first transistor M1. That is, a period between the seventh time point t7 and an eighth time point t8 may be a fourth period Q4 for further compensating for the threshold voltage of the first transistor M1. In one embodiment, for example, the fourth period Q4 may be longer than one horizontal period 1H or the first period Q1.

At a ninth time point t9, when the emission control signal EM[i] transits from the gate-off level to the gate-on level, the fifth transistor M5 and the sixth transistor M6 may be turned on, the driving current by the first transistor M1 may be supplied to the light emitting element EL, and thus the light emitting element EL may emit light at a luminance corresponding to the driving current. A period after the ninth time point t9 may be a fifth period Q5 in which the light emitting element EL emits light.

In an embodiment, as described above, the data may be written to the pixel PX[i, j] of FIG. 9 simultaneously with compensating for the threshold voltage of the first transistor M1 in the third period Q3. In such an embodiment, even though the first scan signal GW[i] and/or the previous first scan signal GW[i−k] are in the gate-off levels, since the second scan signal GW2[*i*] further maintains the gate-on level, the pixel [I, j] may further have the fourth period Q4 for additionally compensating for the threshold voltage of the first transistor M1.

When the driving frequency of the display device DD increases, the fourth period Q4 is reduced, and thus the period for compensating for the threshold voltage of the first transistor M1 is reduced. Therefore, as described with reference to FIG. 8, as the driving frequency increases, a luminance may increase and a swing range of the data voltage may increase.

In an embodiment of the disclosure, the display device DD may be controlled to increase the fourth period Q4 as the driving frequency increases. In one embodiment, for example, the timing controller 200 shown in FIG. 1 may increase the period in which the emission start signal EM_FLM is not supplied according to the driving frequency. When the period in which the emission start signal EM_ELM is not supplied increases according to the driving frequency, the period in which the emission control signal EM[i] of the emission driver 500 is not supplied (the period between the first time point t1 and the ninth time point t9 in FIG. 10) may increase. In addition, the second scan driver 400 may increase the period in which the second scan signal GW2[*i*] is supplied (the period between the first time point t1 and the eighth time point t8 in FIG. 10) according to the driving frequency.

In such an embodiment, the emission start signal EM_FLM may be set differently according to the driving frequency. In one embodiment, for example, the period in which the emission start signal EM_FLM is not supplied may be set to increase as the driving frequency increases. In such an embodiment, the second scan signal GW2[*i*] may be set differently according to the driving frequency. In one embodiment, for example, the period in which the second scan signal GW2[*i*] is supplied may be set to increase as the driving frequency increases.

The invention should not be construed as being limited to the embodiments set forth herein. Rather, these embodiments are provided so that this disclosure will be thorough and complete and will fully convey the concept of the invention to those skilled in the art.

While the invention has been particularly shown and described with reference to embodiments thereof, it will be understood by those of ordinary skill in the art that various changes in form and details may be made therein without departing from the spirit or scope of the invention as defined by the following claims.

What is claimed is:

1. A display device comprising:

a display panel comprising a plurality of pixels;

a timing controller which generates an emission start signal;

an emission driver which supplies an emission control signal to the plurality of pixels based on the emission start signal received from the timing controller;

a first scan driver which supplies a first scan signal to the plurality of pixels;

a second scan driver which supplies a second scan signal to the plurality of pixels; and a data driver which supplies a data signal to the plurality of pixels, wherein the timing controller adjusts a period, in which the emission start signal is supplied, based on a change of a driving frequency, and wherein each of the plurality of pixels comprises:

a first transistor;

a light emitting element comprising a first electrode electrically connected to a second electrode of the first transistor and a second electrode connected to a second power source; and a second transistor connected between a data line which receives the data signal and a third node, wherein the second transistor comprises a gate electrode which receives the first scan signal;

a third transistor connected between the second electrode of the first transistor and a gate electrode of the first transistor, wherein the third transistor comprises a gate electrode which receives the second scan signal;

a fifth transistor connected between a first power source and the first electrode of the first transistor, wherein the fifth transistor comprises a gate electrode which receives the emission control signal; and a sixth transistor connected between the second electrode of the first transistor and the first electrode of the light emitting element, wherein the sixth transistor comprises a gate electrode which receives a previous emission control signal; and a first capacitor connected between the second electrode of the first transistor and the third node.

2. The display device according to claim 1, wherein each of the plurality of pixels further comprises:

a second transistor connected between a data line which receives the data signal and a third node, wherein the second transistor comprises a gate electrode which receives the first scan signal;

a fourth transistor connected between a reference power source which is set differently based on the driving frequency and the third node, wherein the fourth transistor comprises a gate electrode which receives the emission control signal;

a first capacitor connected between the second electrode of the first transistor and the third node;

a second capacitor connected between the first power source and the gate electrode of the first transistor; and a seventh transistor connected between the first electrode of the light emitting element and an initialization power source, wherein the seventh transistor comprises a gate electrode which receives the second scan signal.

3. The display device according to claim 1, wherein the timing controller increases the period in which the emission start signal is supplied, as the driving frequency increases.

4. The display device according to claim 3, wherein the timing controller adjusts a cycle of a clock signal supplied to the emission driver based on the change of the driving frequency.

5. The display device according to claim 3, wherein a supply period of the emission control signal output by the emission driver when the driving frequency is a first driving frequency is the same as a supply period of the emission control signal output by the emission driver when the driving frequency is a second driving frequency, wherein the second driving frequency is greater than the first driving frequency.

6. The display device according to claim 1, wherein the emission driver comprises:

a first emission driver which supplies the emission control signal to the plurality of pixels; and a second emission driver which supplies the previous emission control signal to the plurality of pixels through a line independently of the emission control signal.

7. The display device according to claim 6, wherein the first scan driver or the second scan driver is located on both opposing sides of the display panel to operate in both side driving, or the first emission driver or the second emission driver is located on a single side of the display panel to operate in single side driving.

8. The display device according to claim 6, wherein the first scan driver shifts the first scan signal and supplies a shifted first scan signal to pixels located in one row in the display panel, the second scan driver simultaneously supplies the second scan signal to pixels located in two or more successive rows in the display panel, the first emission driver simultaneously supplies the emission control signal to the pixels located in the two or more successive rows in the display panel, and the second emission driver simultaneously supplies the previous emission control signal to the pixels located in the two or more successive rows in the display panel.

9. The display device according to claim 1, wherein each of the plurality of pixels further comprises:

a fourth transistor connected between the first power source and the third node, wherein the fourth transistor comprises a gate electrode which receives the emission control signal;

a second capacitor connected between the first power source and the gate electrode of the first transistor; and a seventh transistor connected between the first electrode of the light emitting element and an initialization power source, wherein the seventh transistor comprises a gate electrode which receives the second scan signal.

10. The display device according to claim 9, wherein in a period in which the second scan signal is in a gate-on level, a period in which the previous emission control signal is in a gate-on level does not overlap a period in which the emission control signal in a gate-on level.

11. The display device according to claim 9, wherein a voltage of the initialization power source is supplied to the gate electrode of the first transistor and the first electrode of the light emitting element in a first period, a voltage of the first power source is supplied to the first electrode of the first transistor in a second period, the first transistor is diode-connected based on the voltage of the first power source in a third period, and the second transistor is turned on and the data signal is supplied to the third node in a fourth period.

12. The display device according to claim 11, wherein the third transistor is turned on in the first period, the third period and the fourth period, and the third transistor is turned off in the second period.

13. The display device according to claim 12, wherein the fourth transistor and the fifth transistor are turned off and the sixth transistor is turned on in the first period.

14. The display device according to claim 12, wherein the fourth transistor and the fifth transistor are turned on and the sixth transistor is turned off in the third period.

15. A display device comprising:

a display panel comprising a plurality of pixels;

a timing controller which generates an emission start signal;

an emission driver which supplies an emission control signal to the plurality of pixels based on the emission start signal received from the timing controller;

a first scan driver which supplies a first scan signal to the plurality of pixels;

a second scan driver which supplies a second scan signal to the plurality of pixels; and a data driver which supplies a data signal to the plurality of pixels, wherein the timing controller adjusts a period, in which the emission start signal is supplied, based on a change of a driving frequency, and wherein each of the plurality of pixels comprises:

a first transistor;

a light emitting element comprising a first electrode electrically connected to a second electrode of the first transistor and a second electrode connected to a second power source;

a second transistor connected between a data line receiving the data signal and the first electrode of the first transistor, wherein the second transistor comprises a gate electrode which receives the first scan signal;

a third transistor connected between the second electrode of the first transistor and a gate electrode of the first transistor, wherein the third transistor comprises a gate electrode which receives the second scan signal;

a fifth transistor connected between a first power source and the first electrode of the first transistor, wherein the fifth transistor comprises a gate electrode which receives the emission control signal; and a sixth transistor connected between the second electrode of the first transistor and the first electrode of the light emitting element, wherein the sixth transistor comprises a gate electrode which receives the emission control signal.

16. The display device according to claim 15, wherein the second scan driver increases a period in which the second scan signal is supplied, as the driving frequency increases.

17. The display device according to claim 16, wherein each of the plurality of pixels further comprises:

a fourth transistor connected between the gate electrode of the first transistor and an initialization power source, wherein the fourth transistor comprises a gate electrode which receives a previous first scan signal;

a seventh transistor connected between the initialization power source and the first electrode of the light emitting element, wherein the seventh transistor comprises a gate electrode which receives the first scan signal; and a storage capacitor connected between the first power source and the gate electrode of the first transistor.

18. The display device according to claim 17, wherein a period in which the previous first scan signal in in a gate-on level does not overlap a period in which the first scan signal in in a gate-on level.

* * * * *